US010199017B2

(12) United States Patent
Suenaga

(10) Patent No.: US 10,199,017 B2
(45) Date of Patent: Feb. 5, 2019

(54) WIND INSTRUMENT

(71) Applicant: YAMAHA CORPORATION, Hamamatsu-shi (JP)

(72) Inventor: Yuichiro Suenaga, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/754,369

(22) PCT Filed: Sep. 20, 2016

(86) PCT No.: PCT/JP2016/077660
§ 371 (c)(1),
(2) Date: Feb. 22, 2018

(87) PCT Pub. No.: WO2017/057088
PCT Pub. Date: Apr. 6, 2017

(65) Prior Publication Data

US 2018/0254026 A1 Sep. 6, 2018

(30) Foreign Application Priority Data

Sep. 30, 2015 (JP) ..... 2015-192843

(51) Int. Cl.
*G10D 7/06* (2006.01)
*G10D 7/02* (2006.01)
*G10D 9/00* (2006.01)

(52) U.S. Cl.
CPC ..... *G10D 7/06* (2013.01); *G10D 7/02* (2013.01); *G10D 9/00* (2013.01)

(58) Field of Classification Search
None
See application file for complete search history.

(56) References Cited

U.S. PATENT DOCUMENTS 968,694 A 8/1910 Rubright
1,455,440 A 5/1923 Hofinger
(Continued)

FOREIGN PATENT DOCUMENTS

GB 1182919 A 3/1970
JP 50137025 U 11/1975
(Continued)

OTHER PUBLICATIONS

International Search Report issued in International Application No. PCT/JP2016/076954 dated Nov. 29, 2016. English translation provided.

(Continued)

*Primary Examiner* — Robert W Horn
(74) *Attorney, Agent, or Firm* — Rossi, Kimms & McDowell LLP

(57) ABSTRACT

A wind instrument includes: a tube body; and a plurality of tone hole tubes each having an outer open end formed at the outer periphery of the tube body and an inner open end formed through the outer opening end and opening to the inside of the tube body, wherein at least one of the tube body and the tone hole tube is curved such that the plurality of outer open ends of the plurality of tone hole tubes are disposed so as to be in positions corresponding to respective fingers of the performer, and the plurality of inner open ends are connected at positions that cause the tube body to produce a predetermined pitch.

7 Claims, 7 Drawing Sheets

(56) References Cited

U.S. PATENT DOCUMENTS

| | | | | |
|---|---|---|---|---|
| 1,761,329 | A * | 6/1930 | Charlton | G10D 7/06 84/380 R |
| 1,801,690 | A | 4/1931 | Pruefer | |
| 1,809,380 | A * | 6/1931 | Gulick | G10D 7/00 84/382 |
| 3,487,742 | A | 1/1970 | Mills | |
| D218,545 | S | 8/1970 | Frost et al. | |
| 3,722,348 | A | 3/1973 | Visser | |
| 3,805,665 | A | 4/1974 | Oouchi | |
| 3,866,507 | A | 2/1975 | Eajardo | |
| 4,306,484 | A | 12/1981 | Toyama | |
| 4,998,456 | A | 3/1991 | Matti | |
| 5,309,806 | A | 5/1994 | Stavash | |
| D360,904 | S * | 8/1995 | Schilling | D17/10 |
| 6,078,002 | A | 6/2000 | Kenmochi | |
| 6,852,917 | B2 | 2/2005 | McAleenan | |
| 9,959,848 | B2 | 5/2018 | Yonezu | |
| 2003/0070530 | A1 | 4/2003 | McAleenan | |
| 2004/0111865 | A1 | 6/2004 | Craig | |
| 2008/0028914 | A1 | 2/2008 | Straubinger | |
| 2009/0320667 | A1 | 12/2009 | Reiβner | |
| 2011/0219936 | A1 | 9/2011 | Masuda et al. | |
| 2012/0011987 | A1 | 1/2012 | Braun | |
| 2015/0221289 | A1 | 8/2015 | Brockman | |
| 2017/0243570 | A1 | 8/2017 | Clissold | |
| 2018/0254026 | A1 * | 9/2018 | Suenaga | G10D 7/06 |

FOREIGN PATENT DOCUMENTS

| | | | |
|---|---|---|---|
| JP | 52055233 | U | 4/1977 |
| JP | S55033178 | A | 3/1980 |
| JP | 02107198 | U | 8/1990 |
| JP | 05083796 | U | 11/1993 |
| JP | H10171445 | A | 6/1998 |
| JP | 2011186443 | A | 9/2011 |
| JP | 2012063467 | A | 3/2012 |
| JP | 2013213952 | A | 10/2013 |

OTHER PUBLICATIONS

Written Opinion issued in International Application No. PCT/JP2016/076954 dated Nov. 29, 2016.

Copending U.S. Appl. No. 15/753,641, filed Feb. 20, 2018.

International Search Report issued in Intl. Appln. No. PCT/JP2016/077660 dated Dec. 6, 2016. English translation provided.

Written Opinion issued in Intl. Appln. No. PCT/JP2016/077660 dated Dec. 6, 2016.

Yamaha Corporation. "Recorders" Dec. 2014.

* cited by examiner

WIND INSTRUMENT

TECHNICAL FIELD

The present invention relates to a wind instrument.

Priority is claimed on Japanese Patent Application No. 2015-192843, filed Sep. 30, 2015, the content of which is incorporated herein by reference.

BACKGROUND ART

There is a type of wind instrument, such as a recorder shown for example in Non-patent Document 1, in which the tone holes are directly opened and closed mainly by the fingers of the performer. This type of wind instrument has the advantage of being easy to manufacture and inexpensive compared to wind instruments, such as saxophones, in which many tone holes are opened and closed by keys.

PRIOR ART DOCUMENTS

Patent Documents

[Non-patent Document 1] "Recorders", Yamaha Music Japan Co., December 2014

SUMMARY OF THE INVENTION

Problems to be Solved by the Invention

When designing a wind instrument, adjustments are made to the pitch and sound production (for example, the volume, sound quality and the like), and adjustments are made to the arrangement of the plurality of tone holes with respect to the tube body in consideration of operability of the wind instrument. It is possible to adjust pitch by changing the positions of the tone holes in the axial direction of the tube body, the diameter size of the tone holes, and the length dimension of the tone holes (height dimension). It is also possible to adjust sound production by changing the diameter size of the tone holes.

However, in a conventional wind instrument such as a recorder that is operated mainly by fingers, since the length dimension of the tone holes depends on the thickness of the tube wall of the tube body, there is a limit to pitch adjustment by the tone hole length dimension. In addition, in a conventional wind instrument, since the tone holes are formed linearly penetrating the tube body in the radial direction thereof, the degree of freedom in the arrangement of the tone holes in consideration of pitch and operability is low. Moreover, in a conventional wind instrument, with pitch adjustment and adjustment of the tone hole arrangement in consideration of operability being performed in a limited range as mentioned above, a limitation arises also in adjustment of sound production utilizing the diameter size of the tone holes.

That is, in a conventional wind instrument that is operated mainly by fingers, since pitch adjustment, sound production adjustment, and adjustment of the tone hole arrangement in consideration of operability are severely restricted, there is the problem of ensuring both acoustic performance, such as pitch and sound production, and operability being difficult.

The present invention was achieved in view of the above circumstances, and has as its object to provide a wind instrument that can easily ensure both acoustic performance and operability.

Means for Solving the Problems

The present invention provides a wind instrument that is provided with a tube body and a plurality of tone hole tubes each having an outer open end formed at the outer periphery of the tube body and an inner open end formed through the outer opening end and opening to the inside of the tube body, in which at least one of the tube body and the tone hole tubes is curved such that the outer open ends of the plurality of tone hole tubes are in positions corresponding to fingers blocking the outer open ends.

Also, the present invention provides a wind instrument that is provided with a tube body and a plurality of tone hole tubes each having an inner open end formed extending from the outer periphery of the tube body and opening to the inside of the tube body and an outer open end opening to the outside of the tube body, in which the tone hole tube has an inclined tube portion in which the axial line of the tone hole tube is inclined with respect to the radial direction of the tube body such that the outer open ends of the plurality of tone hole tubes are in positions corresponding to fingers blocking the outer open ends.

Effects of the Invention

According to the present invention, it is possible to easily secure both the acoustic performance of the wind instrument and the operability of the wind instrument.

EMBODIMENTS FOR CARRYING OUT THE INVENTION

Hereinbelow, one embodiment of the present invention will be described referring to FIGS. 1 to 3.

Figure 1:
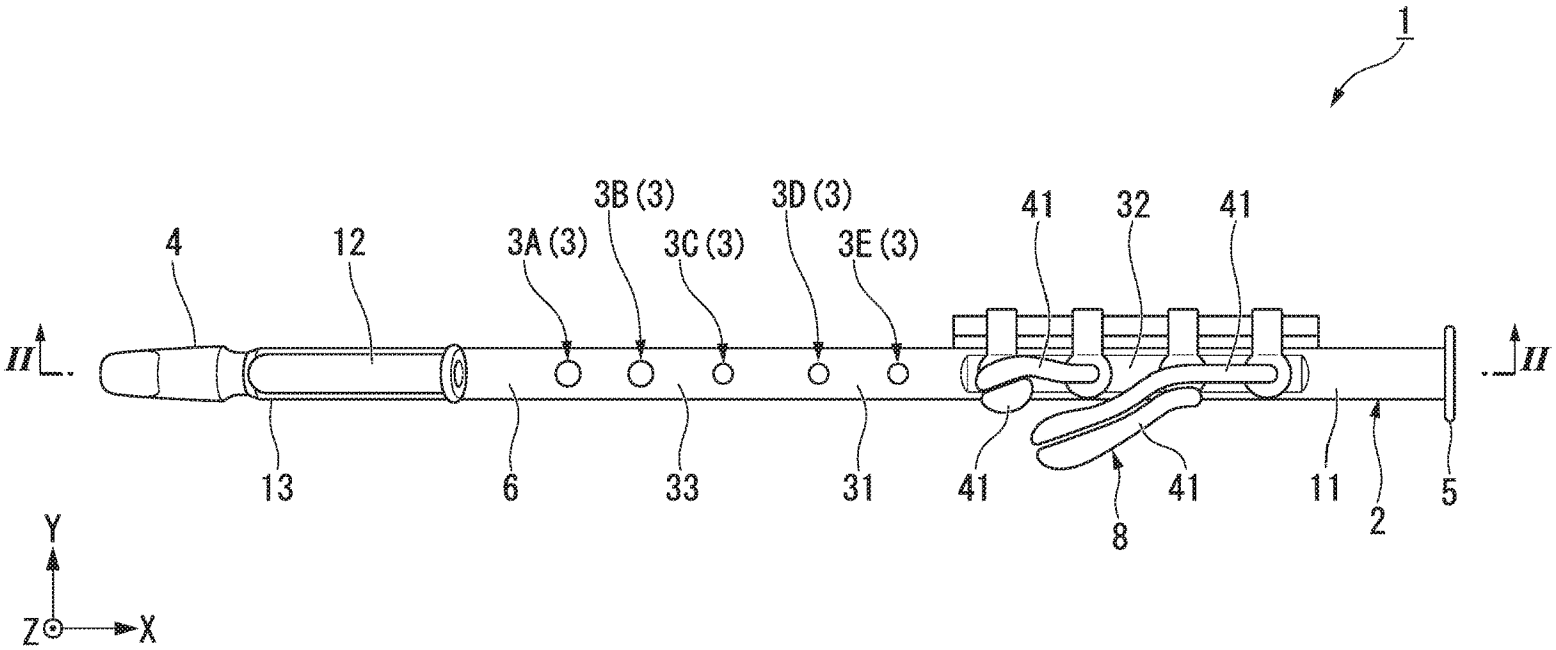
FIG. 1 is a front view showing the wind instrument according to one embodiment of the present invention.
Figure 2:
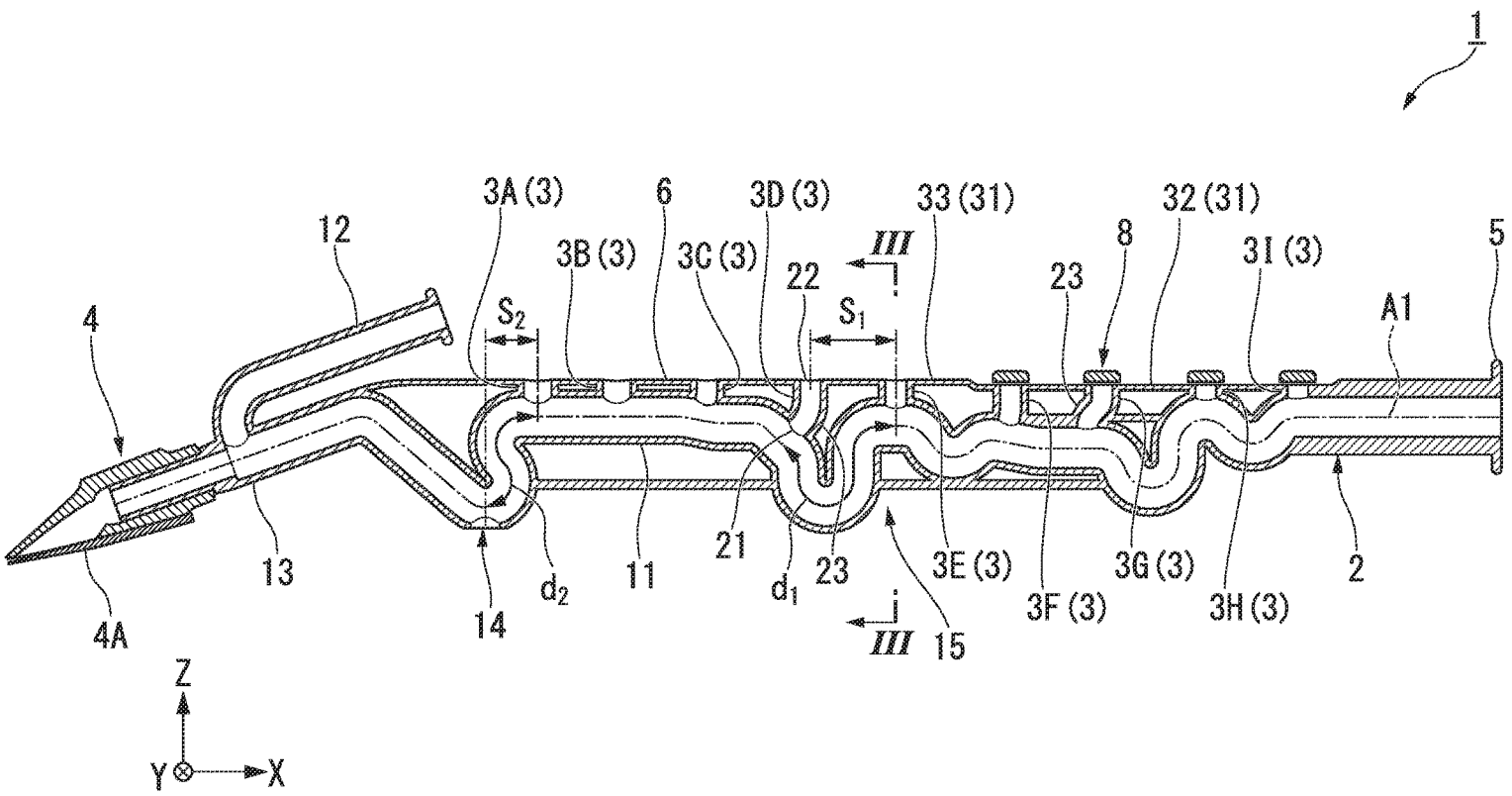
FIG. 2 is a cross-sectional view along arrows II-II of FIG. 1.

As shown in FIGS. 1 and 2, the wind instrument 1 of the present embodiment is provided with a tube body 2, a tone hole tube 3, a mouth piece 4 (blow hole), a bell 5, and a finger pressing plate 6. The mouthpiece 4 and the bell 5 are disposed at both ends of the tube body 2 in the lengthwise direction (X-axis direction). The mouthpiece 4, which may for example be integrally formed with the tube body 2, in this embodiment is detachably mounted on the tube body 2. The mouthpiece 4, which may be a single reed provided with one sheet-like reed 4A as in the illustrated example, may also for example be an air reed, a lip reed, or a double reed.

In the present embodiment, the lengthwise direction of the tube body 2 and the like corresponds to the direction, viewed from a performer playing the wind instrument 1, from the mouthpiece 4 to the bell 5. In the following description, the lengthwise direction of the tube body 2 is called the X-axis direction, the horizontal direction viewed from the performer is called the Y-axis direction of the tube body 2 and the like, and the vertical direction viewed from the performer is called the Z-axis direction of the tube body 2 and the like, as shown in FIGS. 1 to 3.

The tube body 2 may be formed by any one material of for example a wood material, a metal material, and a resin material, and may be formed by for example a material that suitably combines these materials.

The tube body 2 of the present embodiment is provided with a main tube 11, in which at both ends in the lengthwise direction the mouthpiece 4 and the bell 5 are arranged, and an auxiliary tube 12 that is connected to the main tube 11 so as to branch off from the main tube 11.

The main tube 11 and the auxiliary tube 12 are formed in a cylindrical shape with the inner diameter dimension of each being fixed. The auxiliary tube 12 is connected to a first end portion 13 on the mouthpiece 4 side of the main tube 11. In the present embodiment, the auxiliary tube 12 is disposed at a region on the upper side (the upper side in the Z-axis direction) of the main tube 11, and extends in the X-axis direction and Z-axis direction with respect to the main tube 11. That is, the auxiliary tube 12 does not extend in the Y-axis direction with respect to the main tube 11. In the present embodiment, the auxiliary tube 12 extends so as to follow the tube axis A1 that passes through the center of the main tube 11 (refer to FIG. 3A), but is not limited thereto.

As a result of the tube body 2 being provided with the main tube 11 and the auxiliary tube 12, the wind instrument 1 of the present embodiment has the same acoustic characteristics as the case of the tube body 2 being conical.

The tone hole tube 3 constitutes the tone hole of the wind instrument 1 of the present embodiment. The tone hole tube 3 has an inner open end 21 that opens to the inside (inner periphery) of the main tube 11, and an outer open end 22 that opens to the outside of the main tube 11. The tone hole tube 3 is formed in a cylindrical shape with the inner diameter being fixed.

A plurality of the tone hole tubes 3 are arrayed spaced apart in the X-axis direction of the main tube 11.

The position of the inner open end 21 of each tone hole tube 3 along the tube axis A1 of the main tube 11 is set in consideration of the pitch of the wind instrument 1. The inner diameter and axial length of each tone hole tube 3 are individually set in consideration of the pitch and sound production (for example, volume, sound quality and the like) of the wind instrument 1. That is, the inner diameter and axial length of the tone hole tubes 3 mutually differ for the plurality of tone hole tubes 3. In addition, the inner diameter of some of the tone hole tubes 3 (3A to 3E) is set to a size that allows the outer open ends 22 of the tone hole tubes 3 to be blocked by the fingers of the performer.

In the present embodiment, the plurality of tone hole tubes 3 are arranged in a row in the X-axis direction of the main tube 11. More specifically, the inner open ends 21 and outer open ends 22 of the plurality of tone hole tubes 3 are disposed at the same position mutually in the Y-axis direction of the main tube 11. Also, the lateral direction (Y-axis direction) of the main tube 11 is not included in the direction in which the plurality of tone hole tubes 3 extend from the main tube 1. In the present embodiment, the plurality of tone hole tubes 3 are all disposed on the upper side (in the Z-axis direction) of the main tube 11.

The plurality of tone hole tubes 3 each have a portion that extends in the upward direction (Z-axis positive direction) of the main tube 11 with respect to the main tube 11. That is, the tone hole tubes 3A to 3C, 3E, 3F, 3H, and 3I wholly extend straight in the upward direction of the main tube 11. The remaining tone hole tubes 3D, 3G, although the tube axis curves as described below, has a part that extends in the upward direction of the main tube 11.

These tone hole tubes 3 constitute tone holes for pitch operation (pitch tone holes) in which, by being opened and closed, the pitch of the wind instrument 1 changes.

In the present embodiment, the number of the aforementioned tone hole tubes 3 is nine, and it would be difficult to directly open and close all the tone hole tubes 3 with the performer's fingers. For that reason, the wind instrument 1 of the present embodiment is provided with a key mechanism 8 (key system).

The first to fifth tone hole tubes 3A to 3E of the nine tone hole tubes 3, counting from the first end portion 13 side of the main tube 11, are directly opened by the fingers of the performer. The first to third tone hole tubes 3A, 3B, 3C respectively correspond to the index finger, middle finger, and ring finger of the performer's left hand, while the fourth and fifth tone hole tubes 3D and 3E respectively correspond to the index finger and middle finger of the right hand.

The sixth to ninth tone hole tubes 3F to 3I are opened and closed by utilizing the key mechanism 8 (key system). The key mechanism 8 is operated by the ring finger and little finger of the performer's right hand.

Referring to FIG. 2, a thumbhole 14 that is opened and closed by the thumb of the left hand of the performer is also formed in the main tube 11. The thumbhole 14 is formed in the main tube 11 at a position more to the first end portion 13 side than the tone hole tube 3A in the X-axis direction of the main tube 11. The thumbhole 14 of the present embodiment opens to the downward direction of the main tube 11 (negative direction side on the Z axis). The thumbhole 14 changes the pitch of the wind instrument 1 by being opened and closed by a finger of the performer (left hand thumb) similarly to the tone hole tubes 3A to 3E described above.

In the wind instrument 1 of the present embodiment, the main tube 11 and the tone hole tubes 3D and 3G are curved such that the plurality of outer open ends 22 are provided at positions corresponding to the fingers, and the inner open ends 21 are connected with the tube body 1 at a position that causes the tube body 1 to produce a predetermined pitch. Hereinbelow, this point is described in detail.

As shown in FIG. 2, the main tube 11 of the present embodiment is curved a plurality of times in the Z-X plane. That is, the main tube 11 meanders in the vertical direction (Z-axis direction) of the main tube 11. In the present embodiment, the main tube 11 does not meander in the lateral direction (Y-axis direction). By the main tube 11 extending in the lengthwise direction (X-axis direction) while curving in the vertical direction (Z-axis direction), the linear length of the main tube 11 in the lengthwise direction (X-axis direction) of the main tube 11 becomes shorter than the length of the main tube 11 along the tube axis A1 of the main tube 11.

The meandering direction of the main tube 11 may also for example be the lateral direction (Y-axis direction) of the main tube 11.

In the portions where the main tube 11 bends, the linear distance of the interval between adjacent tone hole tubes 3 in the X-axis direction of the main tube 11 is smaller than the interval between adjacent tone hole tubes 3 in the tube axis A1 of the main tube 11. For example, the main tube 11 curves at the portion positioned between the fourth tone hole tube 3D and the fifth tone hole tube 3E. Thereby, the linear distance $s_1$ of the interval of the tone hole tube 3D and the tone hole tube 3E in the X-axis direction of the main tube 11 is smaller than the length $d_1$ of the interval of the tone hole tube 3D and the tone hole tube 3E along the tube axis A1 of the main tube 11.

The inner open end 21 of the tone hole tube 3D and the inner open end 21 of the tone hole tube 3E are connected to the main tube 11 at positions at which the interval along the tube axis becomes the predetermined length $d_1$, such that a predetermined pitch is produced.

Similarly, the main tube 11 is curved at the portion positioned between the first tone hole tube 3A that is opened and closed by the index finger of the left hand and the thumbhole 14 that is opened and closed by the thumb of the left hand. Thereby, the linear distance $s_2$ of the interval between the tone hole tube 3A and the thumbhole 14 in the X-axis direction of the main tube 11 is smaller than the length $d_2$ of the interval of the tone hole tube 3A and the thumbhole 14 along the tube axis A1 of the main tube 11.

In the present embodiment, the main tube 11 meanders in the Z-axis direction. For this reason, there are portions positioned relatively high (in the Z-axis positive direction) and portions positioned relatively low (in the Z-axis negative direction) in the main tube 11.

The tone hole tubes 3A to 3C, 3E, 3F, 3H, 3I whose lengths in the tube axis direction are comparatively short, are connected to portions of the main tube 11 that are positioned relatively high. On the other hand, the tone hole tubes 3D and 3G whose lengths in the tube axis direction are comparatively long are connected to portions of the main tube 11 that are positioned relatively low. Thereby, the outer open ends 22 of the plurality of tone hole tubes 3 are positioned in close proximity to each other in the Z-axis direction of the main tube 11. In the present embodiment, by combining with the curving of some tone hole tubes 3 as described below, the outer open ends 22 of the plurality of tone hole tubes 3 are positioned at the same position in the vertical direction (on the same X-Y plane).

Also, in the present embodiment, by the meandering of the main tube 11 in the Z-axis direction, a depression portion 15 is formed at a region on the lower side (Z-axis negative direction) of the main tube 11. The depression portion 15 is provided near the fourth and fifth tone hole tubes 3D and 3E that are opened and closed by the index finger and middle finger of the right hand in the X-axis direction of the main tube 11. The depression portion 15 may be positioned on the lower side of the fifth tone hole tube 3E as illustrated in FIG. 2, and may for example be positioned between the fourth and fifth tone hole tubes 3D and 3E in the lengthwise direction of the main tube 11.

By placing the right hand thumb of the performer at the depression portion 15, it is possible to stably hold the wind instrument.

In the wind instrument 1 of the present embodiment, the tone hole tubes 3D and 3G whose lengths along the tube axis are set to be long compared with the other tone hole tubes 3A to 3C, 3E, 3F, 3H, 3I curve to be connected to the main tube 11. That is, the tone hole tubes 3A to 3C, 3E, 3F, 3H, 3I with a comparatively short length along the tube axis extend straight in the upward direction from the main tube 11. Also, the tone hole tubes 3D and 3G with a comparatively long length along the tube axis (3D and 3G) extend in the upward direction while curving from the main tube 11.

In the present embodiment, the tone hole tubes 3D and 3G that are curved have a curved tube portion 23 that changes the direction of the tube axial line of the tone hole tubes 3D and 3G midway along the tube axis of the tone hole tubes 3D and 3G. The curved tube portion 23 may be a portion of the tone hole tubes 3D and 3G as illustrated in FIG. 2, and for example may be the entirety of the tone hole tubes 3D and 3G.

The direction of curving of the tone hole tubes 3D and 3G is the X-axis direction of the main tube 11 in the present embodiment. That is, the tone hole tubes 3D and 3G of the present embodiment are not curved in the Y-axis direction of the main tube 11.

As another embodiment, an embodiment is also conceivable in which the tone hole tubes are for example distorted in the Y-axis direction of the main tube 11.

In the present embodiment, by the curving of the tone hole tubes 3D and 3G with a comparatively long axial length, the position and direction of each outer open end 22 of the plurality of tone hole tubes 3 is favorably set in consideration of the operability of the wind instrument 1.

For example, by the curving of the fourth tone hole tube 3D that is blocked by the index finger of the right hand, the outer open end 22 of the tone hole tube 3D and the outer open end 22 of the fifth tone hole tube 3E that is blocked by the middle finger of the right hand are positioned in mutual proximity in the X-axis direction and Z-axis direction of the main tube 11. That is, by the bending of the tone hole tube 3D, the outer open ends 22 of the plurality of tone hole tubes 3D and 3E that are blocked by fingers of the same hand are positioned in mutual proximity.

The direction of the inner open end 21 of this tone hole tube 3D differs from the inner open ends 21 of the other tone hole tubes 3A, 3B, 3C, 3E and the like and is inclined in the X-axis and Z-axis directions of the main tube 11 with respect to the upper side in the height direction of the main tube 11. However, the direction of the outer open end 22 of the tone hole tube 3D is the Z-axis positive direction (upward direction) of the main tube 11, similarly to the outer open ends 22 of the other tone hole tubes 3. While the tone hole tube 3D may for example be curved a plurality of times, in the present embodiment the fourth tone hole tube 3D is curved only once.

The seventh tone hole tube 3G that is opened and closed by using the key mechanism 8 extends in the Z-axis positive direction by being curved from the inner open end 21 in the X-axis positive direction. Thereby, the intervals in the X-axis direction between the outer open end 22 of the tone hole tube 3G and the outer open ends 22 of the sixth and eighth tone hole tubes 3F and 3H is adjusted in consideration of the configuration of the key mechanism. In the present embodiment, the tone hole tube 3G may also meander by being curved a plurality of times.

Also, in the present embodiment, although the main tube 11 and the tone hole tubes 3 are curved, the vertical positions of the outer open ends 22 of the plurality of tone hole tubes 3A to 3E and the vertical positions of the outer open ends 22 of the plurality of tone hole tubes 3F to 3I mutually align in the Z-axis direction of the main tube 11. In the example shown in FIG. 2, although the positions in the Z-axis direction of the main tube 11 slightly differ between the outer open ends 22 of the tone hole tubes 3A to 3E that are directly opened and closed by fingers and the outer open ends 22 of the tone hole tubes 3F to 3I that are opened and closed by using the key mechanism 8, the positions may be made to align.

As shown in FIGS. 1 to 3, the finger pressing plate 6 extends from the outer open end 22 of the tone hole tube 3 to the outside in the radial direction of the tone hole tubes 3. That is, the finger pressing plate 6 is a flange that is formed at the outer open end 22 of the tone hole tube 3. The finger pressing plate 6 is disposed spaced apart with respect to the outer periphery of the main tube 11. In the present embodiment, the outer open end 22 of the tone hole tube 3 faces the upper side (Z-axis positive direction) of the main tube 11. For this reason, the finger pressing plate 6 extends in the X-axis and Y-axis directions of the main tube 11, which are perpendicular to the vertical direction (Z-axis direction).

In the present embodiment, a common finger pressing plate 6 is provided for the plurality of tone hole tubes 3. That is, the same finger pressing plate 6 is provided for the plurality of tone hole tubes 3.

In the present embodiment, since the outer open ends 22 of the plurality of tone hole tubes 3 are arrayed in the X-axis direction, the finger pressing plate 6 is formed in a band plate shape extending in the X-axis direction of the main tube 11. Also, in the present embodiment, the dimension of the finger pressing plate 6 in the Y-axis direction of the main tube 11 (width dimension) is set so as not to protrude from both ends in the Y-axis direction (lateral direction) of the main tube 11, in consideration of the operability by the performer.

The finger pressing plate 6 should be provided for at least the tone hole tubes 3A to 3E that are directly opened and closed by the fingers, but as shown in FIG. 2, in the present embodiment the finger pressing plate 6 is also provided for the tone hole tubes 3F to 3I that are opened and closed by using the key mechanism 8.

The finger pressing plate 6 has the surface to which the outer open end 22 of the tone hole tube 3 opens (opening surface 31).

Figure 3A:
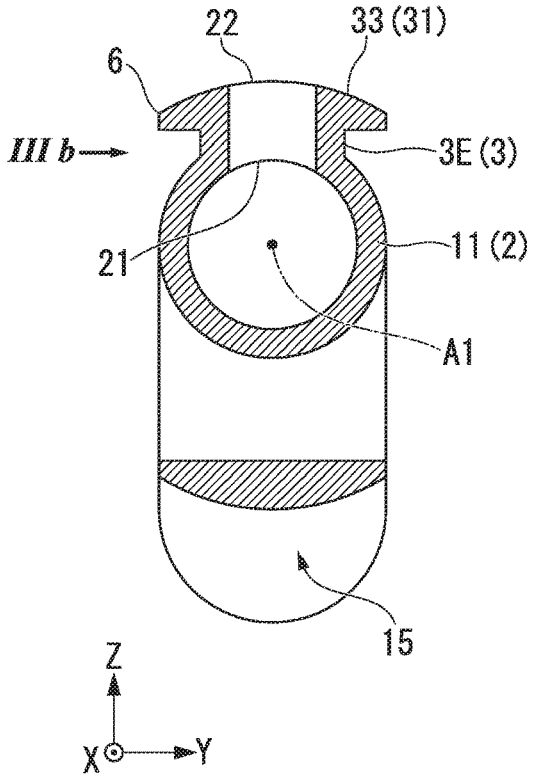
FIG. 3A is a cross-sectional view along arrows III-III of FIG. 2.

Among the opening surface 31 of the finger pressing plate 6, the region where the outer open ends 22 of the tone hole tubes 3 opened and closed by the key mechanism 8 are disposed (hereinbelow called the key opening surface 32) is formed to be planar. On the other hand, among the opening surface 31 of the finger pressing plate 6, the region where the outer open ends 22 of the tone hole tubes 3 directly opened and closed by fingers are disposed (hereinbelow called the finger opening surface 33) is formed to be curved, as shown in FIG. 3A.

Figure 3B:
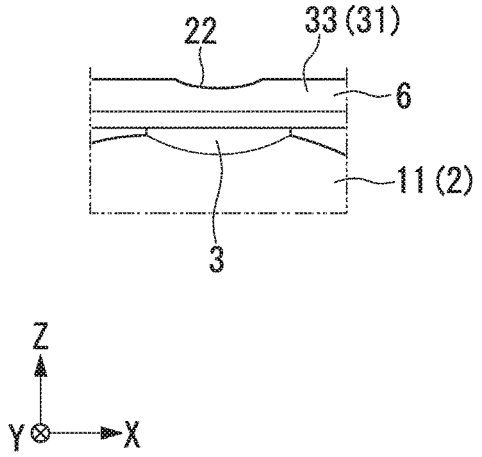
FIG. 3B is a partial side view in the direction of arrow IIIb of FIG. 3A.

In the present embodiment, the finger opening surface 33 curves in a convex shape when viewed from the X-axis direction of the main tube 11 (refer to FIG. 3A), and is formed to be a curved surface that does not curve when viewed from the Y-axis direction of the main tube 11 (refer to FIG. 3B). Thereby, as shown in FIG. 3B, a dent in which a finger enters is formed at the outer open end 22 of the tone hole tube 3.

As described above, in the wind instrument 1 of the present embodiment, it is possible to adjust the pitch of the wind instrument 1 by changing the position (position along the tube axis A1) of the inner open end 21 of the tone hole tube 3 with respect to the main tube 11 and the length in the tube axis direction of the tone hole tube 3 (length dimension of the tone hole). By the curving of the main tube 11 and the tone hole tubes 3, it is possible to suitably adjust the arrangement of the outer open ends 22 of the plurality of tone hole tubes 3 in consideration of operability of the wind instrument 1 so as not to hinder adjustment of pitch. Moreover, since there is no longer a need to use the diameter of the tone holes as the aforementioned main adjustment of pitch, it is possible to effectively utilize the inner diameter of the tone hole tubes 3 (diameter dimension of the tone holes) for sound production of the wind instrument 1.

Further describing these points, although it is possible to adjust the pitch of the wind instrument 1 by changing the inner diameter dimension of the tone hole tubes 3, in the present embodiment, it is possible to freely change the length of the tone hole tubes 3 along the tube axis without impairing the operability of the wind instrument 1. For this reason, in the wind instrument 1 of the present embodiment, it is possible to sufficiently adjust the pitch of the wind instrument 1 by changing the length of the tone hole tube 3 instead of changing the inner diameter dimension of the tone hole tube 3. On the other hand, although the sound production of the wind instrument 1 is adjusted by changing the inner diameter dimension of the tone hole tubes 3, in the wind instrument 1 of the present embodiment, since it is not required to use changes of the internal diameter dimension of the tone hole tubes 3 for pitch adjustment, it is possible to suppress the influence of pitch adjustment on adjustment of sound production.

That is, according to the wind instrument 1 of the present embodiment, it is possible to relax restrictions on pitch adjustment, sound production adjustment, and adjustment of the tone hole arrangement in consideration of operability. Accordingly, it is possible to easily ensure both the acoustic performance of the wind instrument 1 and the operability of the wind instrument 1.

Also, according to the wind instrument 1 of the present embodiment, the plurality of tone hole tubes 3 each have a portion that extends in the vertical direction (Z-axis direction) of the main tube 11 with respect to the main tube 11, and the meandering direction of the main tube 11 is parallel with the vertical direction of the main tube 11.

For this reason, it is possible to mutually space apart the positions of the inner open ends 21 of the plurality of tone hole tubes 3 in the vertical direction of the main tube 11. Thereby, even if the lengths along the tube axis of the plurality of tone hole tubes 3 mutually differ, it is possible to mutually approximate the outer open ends 22 of the plurality of tone hole tubes 3 in the vertical direction of the main tube 11. As a result, it is possible to easily block the outer open ends 22 of the plurality of tone hole tubes 3 with a plurality of fingers. That is, it is possible to easily ensure the operability of the wind instrument 1.

In the wind instrument 1 of the present embodiment, by the meandering direction of the main tube 11 being parallel with the vertical direction of the main tube 11, it is possible to reduce the interval between the first tone hole tube 3A that is opened and closed by the index finger of the left hand and the thumbhole 14 that is opened and closed by the thumb of the left hand. For this reason, when blocking both the first tone hole tube 3A and the thumbhole 14, it is possible to grip the tube body 2 in a pinching manner with the left hand thumb and index finger. That is, it is possible for the performer to stably grip the wind instrument 1 and so it is possible to achieve an improvement in the operability of the wind instrument 1.

In the wind instrument 1 of the present embodiment, by the reduction in the interval between the outer open ends 22 of the tone hole tubes 3 due to the curving of the main tube 11 and the tone hole tubes 3, it is possible to configure the key mechanism 8 in a compact manner.

Specifically, since it is possible to increase the number of the outer open ends 22 of the tone hole tubes 3 that can be directly blocked by fingers, it is possible to reduce the number of tone hole tubes 3 that are opened and closed using the key mechanism 8. That is, it is possible to reduce the number of operators 41 (keys) of the key mechanism 8. Also, since it is possible to set short the length of the operators 41 of the key mechanism 8, it is also possible to achieve an improvement in reliability of the wind instrument 1.

In addition, according to the wind instrument 1 of the present embodiment, by the main tube 11 meandering in the vertical direction (Z-axis direction), the depression portion 15 is formed at a region on the lower side of the main tube 11. By the right hand thumb of the performer being placed at this depression portion 15, the performer can grip the wind instrument 1 in a stable manner. Also, in the state of the right hand thumb being placed at the depression portion 15, since the right hand is stably positioned with respect to the main tube 11, it is also possible to perform a stable opening and closing operation of the tone hole tubes 3 with the performer's fingers excluding the right hand thumb.

Also, according to the wind instrument 1 of the present embodiment, since the tone hole tubes 3 that are curved each have a curved tube portion 23, it is possible to freely and suitably arrange the outer open ends 22 of the tone hole tubes 3 with respect to the inner open ends 21. That is, it is possible to easily ensure the operability of the wind instrument 1.

In the wind instrument 1 of the present embodiment, the main tube 11 meanders only in the vertical direction, and the plurality of tone hole tubes 3 extend only in the vertical direction (Z-axis direction) and lengthwise direction (X-axis direction) from the main tube 11. The plurality of tone hole tubes 3 are arranged in a row in the lengthwise direction of the main tube 11.

For this reason, it is possible to make the shape of the structure including the main tube 11 and the plurality of tone hole tubes 3 a symmetrical shape based on the center of the main tube 11 in the lateral direction (Y-axis direction). Thereby, when manufacturing this structure, a pair of separate structures formed in symmetrical shapes, after being molded, may be fixed so as to be bonded together. Accordingly, it is possible to easily manufacture the wind instrument 1.

According to the wind instrument 1 of the present embodiment by the tone hole being constituted by the tone hole tube 3, it is possible to set the thickness of the tube wall of the tube body 2 without consideration to the length of the tone hole. Thereby, it is possible to thinly form the tube wall of the tube body 2. Accordingly, it is possible to economize resources for constituting the wind instrument 1 and it is possible to achieve a reduction in weight of the wind instrument 1.

Since the wind instrument 1 of the present embodiment is provided with the finger pressing plate 6, the performer can easily judge by the sense of touch of a finger whether the outer open end 22 of the tone hole tube 3 is correctly blocked by the finger. Hereinbelow, this point is explained in detail.

In the case of no finger pressing plate 6, when the performer blocks the outer open end 22 of the tone hole tube 3 with his own finger, the finger of the performer may touch not only the inner edge of the outer open end 22 but also the outer edge, with these feelings all being transmitted to the finger of the performer. For this reason, it is difficult for the performer to judge whether the outer open end 22 of the tone hole tube 3 is correctly blocked.

In contrast to this, in the case of the finger pressing plate 6 being present, when blocking the outer open end 22 of the tone hole tube 3 with a finger, the finger makes no contact with the outer edge of the outer open end 22. Thereby, the performer easily ascertains the inner edge of the outer open end 22 of the tone hole tube 3 by the feeling of the finger. That is, the performer can easily judge by the feeling of the finger whether the outer open end 22 of the tone hole tube 3 is correctly blocked by the finger.

In addition, in the wind instrument 1 of the present embodiment equipped with the finger pressing plate 6, when a finger of the performer is not blocking the outer open end 22 of the tone hole tube 3, it is also possible to place the finger on the opening surface 31 of the finger pressing plate 6 (in particular, the finger opening surface 33). For this reason, the performer can easily move his fingers from a position that does not block the outer open ends 22 of the tone hole tubes 3 to a position that does block the outer open ends 22 of the tone hole tubes 3.

Also, since the wind instrument 1 of the present embodiment is provided with the finger pressing plate 6, the performer can easily perform the operation that blocks the outer open ends 22 of the tone hole tubes 3 with his own fingers. Hereinbelow, this point is described in detail.

In the case of no finger pressing plate 6, in the event of the performer attempting to block the outer open end 22 of the tone hole tube 3 with his own finger, when the finger of the performer becomes separated from the outer open end 22 of the tone hole tube 3, the finger becomes positioned on the outer periphery of the tone hole tube 3. In this case, it is necessary to lift the finger from the outer periphery of the tone hole tube 3 and move the finger to the position blocking the outer open end 22 of the tone hole tube 3, and so the operability of the wind instrument 1 is not necessarily favorable.

In contrast to this, in the case of the finger pressing plate 6 being present, even if a finger of the performer becomes separated from the outer open end 22 of the tone hole tube 3, since the finger abuts the finger opening surface 33 of the finger pressing plate 6, the finger need only be moved along the finger opening surface 33 to the outer open end 22. That is, since the need to lift the finger is eliminated, even if the finger of the performer becomes separated from the outer open end 22 of the tone hole tube 3, the performer can easily perform the operation of blocking the outer open end 22 of the tone hole tube 3 with his own finger.

From the above, according to the wind instrument 1 of the present embodiment, it is possible to ensure the operability of the wind instrument 1 by the performer with the presence of the finger pressing plate 6.

Also, according to the wind instrument 1 of the present embodiment, the same finger pressing plate 6 is provided for the plurality of tone hole tubes 3. For this reason, the edge portion at the distal end in the extending direction of the finger pressing plate 6 (the region corresponding to the edge of the finger opening surface 33) is not located between the outer open ends 22 of adjacent tone hole tubes 3. For this reason, it is possible to lower the possibility of a finger of the performer touching the edge portion at the distal end in the extending direction of the finger pressing plate 6. Thereby, the performer can further easily ascertain whether the outer open end 22 of the tone hole tube 3 is correctly blocked by a finger with the feeling of the finger.

Also, according to the wind instrument 1 of the present embodiment, the gap between adjacent tone hole tubes 3 is covered by the finger pressing plate 6. For that reason, when the performer tries to block the outer open end 22 of the tone hole tube 3 with that finger, even if the performer's finger becomes separated from the outer open end 22 of the tone hole tube 3, it is possible to prevent the performer's finger from entering the gap between adjacent tone hole tubes 3. Thereby, even if the performer's finger is separated from the outer open end 22 of the tone hole tube 3, the need to lift the finger is eliminated, and the performer can easily perform the operation of blocking the outer open end 22 of the tone hole tube 3 with his own finger.

From the above, by the same finger pressing plate 6 being provided for the plurality of tone hole tubes 3, it is possible to more favorably ensure the operability of the wind instrument 1 by the performer.

By the same finger pressing plate 6 being provided for the plurality of tone hole tubes 3, in the case of fabricating the tube body 2 of the wind instrument 1, the tone hole tubes 3 and the finger pressing plate 6 by resin molding, compared to the case of the finger pressing plate 6 being provided for each tone hole tube 6, it is possible to achieve a simplification of the mold shape. Thereby, it is possible to easily manufacture the wind instrument 1. Also, it is possible to achieve a reduction in the manufacturing cost of the wind instrument 1.

According to the wind instrument 1 of the present embodiment, since the finger opening surface 33 of the finger pressing plate 6 is formed into a curved surface, the performer can correctly and easily block the outer open end 22 of the tone hole tube 3 with a finger. Specifically, by the finger opening surface 33 of the finger pressing plate 6 being formed into a curved surface, a dent shape in which the finger enters is formed at the outer open end 22 of the tone hole tube 3. For this reason, the performer can correctly and easily block the outer open end 22 of the tone hole tube 3 by causing the finger to enter the outer open end 22 made to have a dent shape.

Although the present invention was described in detail above, the present invention is not limited to the aforementioned embodiments, and various modifications can be made within a scope that does not depart from the gist of the present invention.

Figure 4:
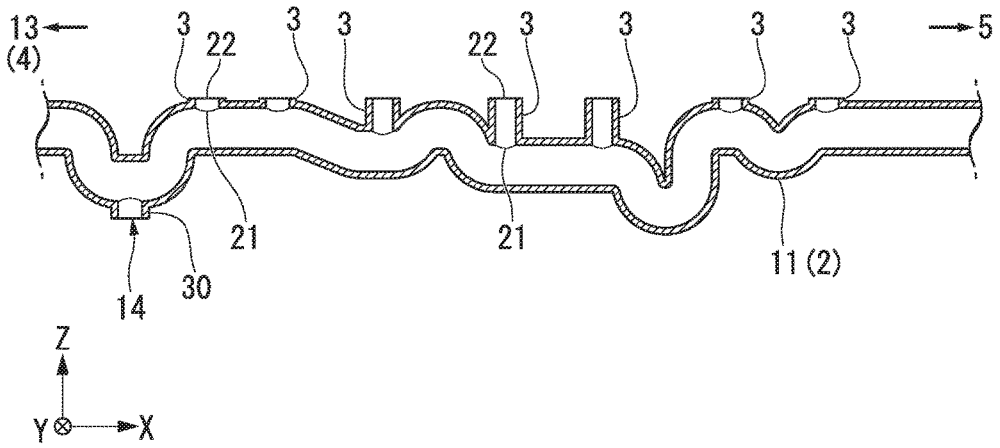
FIG. 4 is a cross-sectional view showing the wind instrument according to another embodiment of the present invention.
Figure 5:
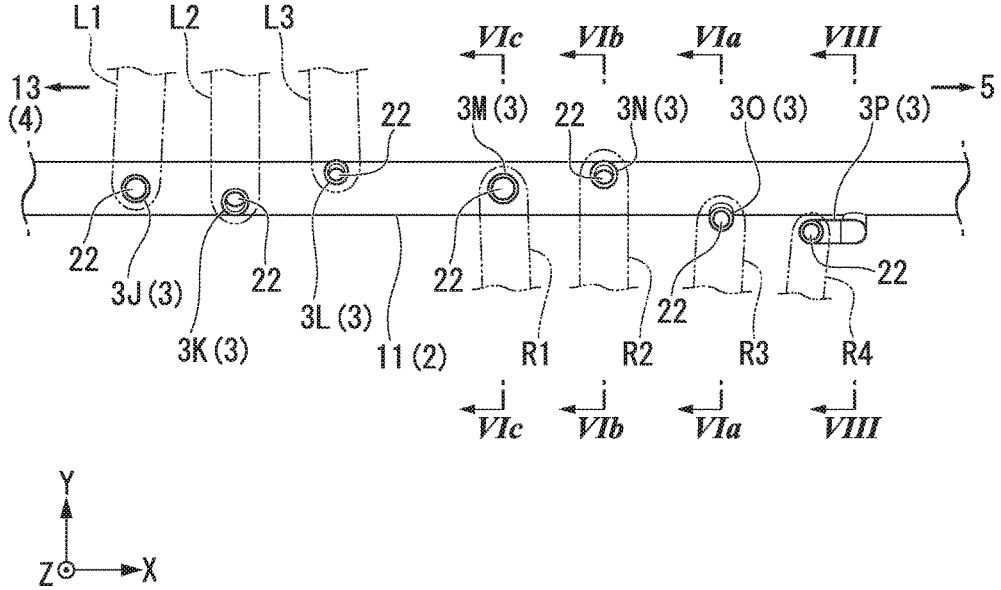
FIG. 5 is a front view showing the wind instrument according to yet another embodiment of the present invention.

The wind instrument of the present invention is not limited to one that includes the key mechanism 8, and may be applied to a wind instrument of a type in which all of the tone hole tubes 3 are directly opened and closed by fingers, as shown for example in FIG. 4 and FIG. 5.

In the wind instrument of the present invention, the finger pressing plate 6 may for example be individually provided for the plurality of tone hole tubes 3. That is, the wind instrument may be provided with a plurality of finger pressing plates 6. In addition, the wind instrument of the present invention may not be provided with the finger pressing plate 6 as shown for example in FIGS. 4 to 9.

In the wind instrument of the present invention, at least one of the main tube 11 and the tone hole tubes 3 should be curved.

In the constitution shown in FIG. 4, only the main tube 11 is curved, while the tone hole tubes 3 are not curved. As shown in FIG. 4, even if only the main tube 11 is curved, it is possible to ensure the operability of the wind instrument by reducing the interval between the outer open ends 22 of the tone hole tubes 3.

On the other hand, in the constitution illustrated in FIG. 5, FIG. 6A, FIG. 6B, FIG. 6C, FIG. 7, and FIG. 8, only the tone hole tube 3 is curved, while the main tube 11 is not curved. Even if only the tone hole tube 3 is curved, due to the curving of the tone hole tube 3 so as to extend in the lengthwise direction of the main tube 11, it is possible to ensure the operability of the wind instrument by reducing the interval between the outer open ends 22 of the tone hole tubes 3.

In the case of the main tube 11 meandering by being curved a plurality of times, the meandering direction of the main tube 11 is not limited to the vertical direction (Z-axis direction) of the main tube 11 as illustrated in FIGS. 2 and 4, and should at least be a direction orthogonal to the lengthwise direction (X-axis direction) of the main tube 11. That is, the meandering direction of the main tube 11 may also for example be the lateral direction (Y-axis direction) of the main tube 11.

Figure 6A:
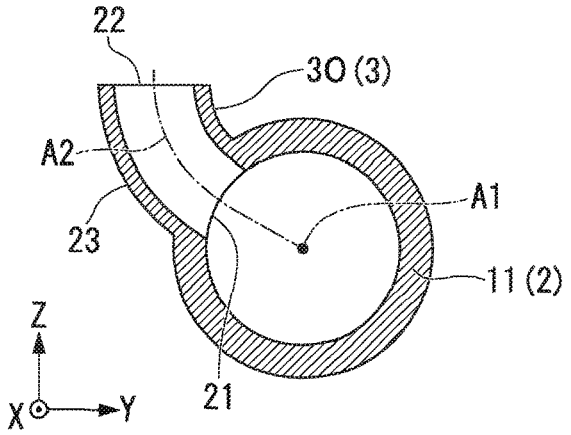
FIG. 6A is a cross-sectional view along arrows VIa-VIa of FIG. 5.
Figure 6B:
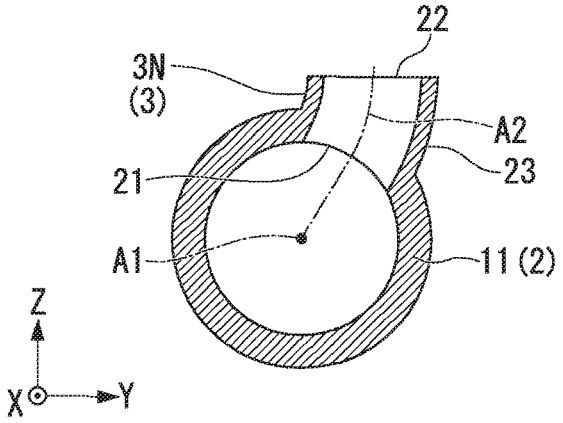
FIG. 6B is a cross-sectional view along arrows VIb-VIb of FIG. 5.
Figure 6C:
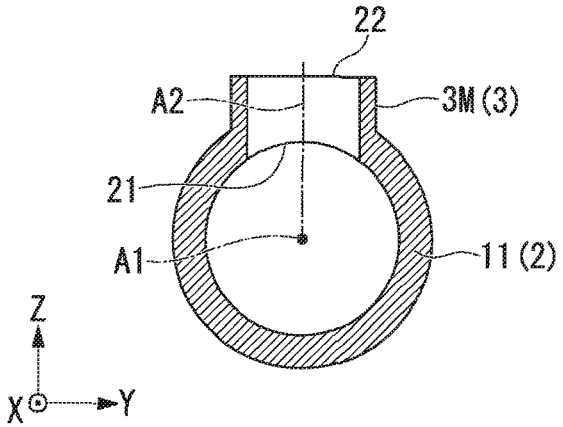
FIG. 6C is a cross-sectional view along arrows VIc-VIc of FIG. 5.
Figure 7:
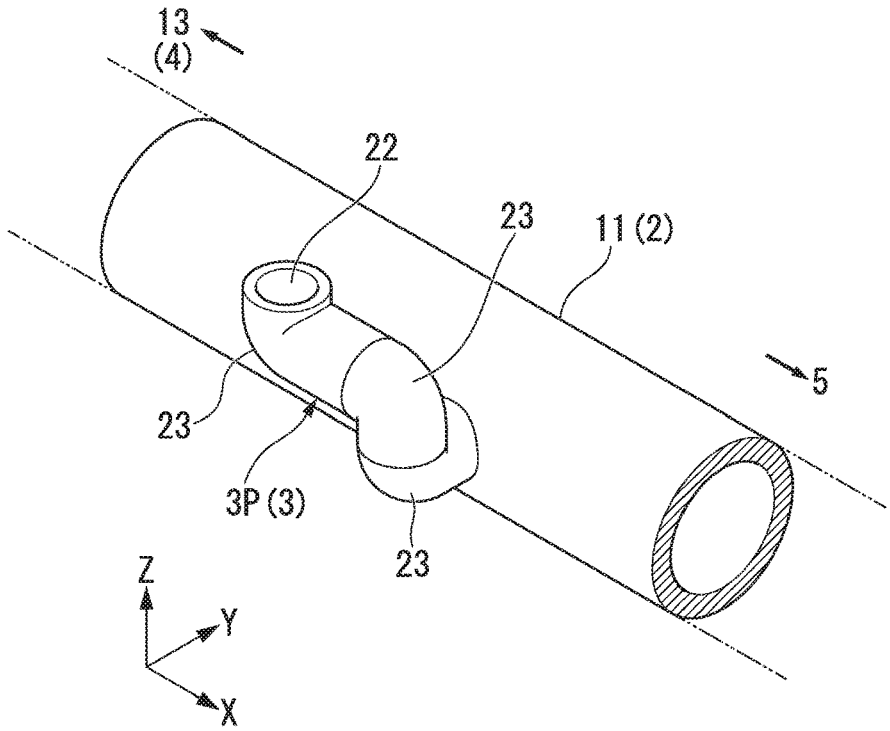
FIG. 7 is a perspective view showing a tone hole tube in the embodiment of FIG. 5.
Figure 8:
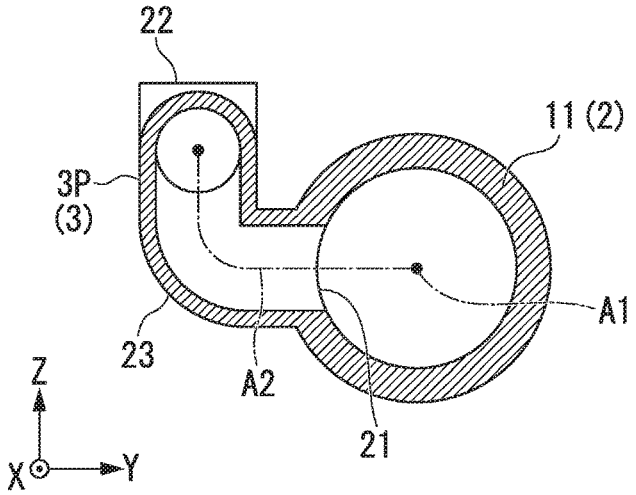
FIG. 8 is a cross-sectional view along arrows VIII-VIII of FIG. 5.

In the case of the tone hole tube 3 being curved, as shown for example in FIG. 6A, FIG. 6B, and FIG. 8, the tone hole tube 3 may be curved so that the outer open end 22 of the tone hole tube 3 is shifted in position in the lateral direction (Y-axis direction) of the main tube 11 with respect to the inner open end 21. Also, the tone hole tube 3 may be curved so that the direction of the outer open end 22 differs from the direction of the inner open end 21.

The inner open ends 21 of the plurality of tone hole tubes 3 may also mutually be disposed at mutually different positions in the circumferential direction of the main tube 11, as shown for example in FIGS. 5 to 8.

The outer open ends 22 of the plurality of tone hole tubes 3 may also be disposed at mutually different positions in the lateral direction (Y-axis direction) of the main tube 11, as shown for example in FIGS. 5 to 8. In the constitution illustrated in FIG. 5, the outer open ends 22 of the plurality of tone hole tubes 3 are positioned in a manner mutually shifted in the lateral direction of the main tube 11 in accordance with the lengths of the mutually different fingers L1 to L3, R1 to R4.

Described in detail, the first to third tone hole tubes 3J to 3L, counting from the first end portion 13 side of the main tube 11, correspond to the index finger L1, the middle finger L2, and the ring finger L3, respectively, of the left hand of the performer. For that reason, the second tone hole tube 3K is positioned in a manner shifted to the right side (the Y-axis negative direction side in FIG. 5) of the main tube 11 with respect to the first and third tone hole tubes 3J and 3L, so as to be positioned the furthest away from the base of the left hand fingers.

On the other hand, the fourth to seventh tone hole tubes 3M to 3P, counting from the first end portion side of the main tube 11, correspond to the index finger R1, the middle finger R2, the ring finger R3, and the little finger R4, respectively, of the right hand of the performer. For that reason, the fifth tone hole tube 3N is positioned in a manner shifted to the left side (the Y-axis positive direction side in FIG. 5) of the main tube 11 with respect to the fourth, sixth, and seventh tone hole tubes 3M, 3O, and 3P, so as to be positioned the furthest away from the base of the right hand fingers. Also, the seventh tone hole tube 3P is positioned in a manner shifted to the right side (the Y-axis negative direction side in FIG. 5) of the main tube 11 with respect to the fourth to sixth tone hole tubes 3M to 3O, so as to be positioned the nearest to the base of the finger R4 of the right hand.

The outer open ends 22 of the plurality of tone hole tubes 3 may for example be disposed at mutually different positions in the vertical direction (Z-axis direction) of the main tube 11. Also, the directions of the outer open ends 22 of the plurality of tone hole tubes 3 may mutually differ.

Figure 9:
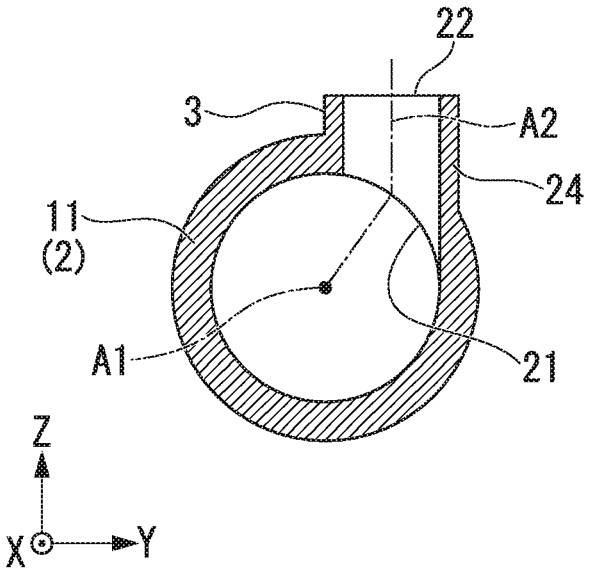
FIG. 9 is a cross-sectional view showing the tone hole tube of the wind instrument according to another embodiment of the present invention.

Although the tone hole tube 3 may as shown for example in FIG. 6A, FIG. 6B, and FIG. 8 have the curved tube portion 23 that changes the direction of the tube axis A2 of the tone hole tube 3 midway in the axial direction of the tone hole tube 3, as shown for example in FIG. 9, the tube axis A2 of the tone hole tube 3 may also have an inclined tube portion 24 that is inclined with respect to the radial direction of the main tube 11. In this case, the tube axis A2 of each tone hole tube 3 should extend in a direction inclined to the radial direction of the main tube 11 so that the outer open ends 22 of the plurality of tone hole tubes 3 have positions corresponding to the fingers that block them.

The inclined tube portion 24 may constitute the entirety of the tone hole tube 3 as illustrated in FIG. 9, and may for example constitute a portion of the tone hole tube 3. Accordingly, the tone hole tube 3 may have for example both the curved tube portion 23 and the inclined tube portion 24.

The direction in which the tone hole tube 3 is inclined by the inclined tube portion 24 may be arbitrary. The direction in which the tone hole tube 3 is inclined may be set so that, as shown for example in FIG. 9, the outer open end 22 of the tone hole tube 3 is positioned in a manner shifted in the circumferential direction of the main tube 11 with respect to the inner open end 21. Also, the direction in which the tone hole tube 3 is inclined may be set so that for example the outer open end 22 of the tone hole tube 3 is positioned in a manner shifted in the tube axis or lengthwise direction of the main tube 11 with respect to the inner open end 21.

Even in the case of the tone hole tube 3 having the inclined tube portion 24, it is possible to freely and suitably arrange the outer open ends 22 of the tone hole tubes 3 with respect to the inner open ends 21. That is, it is possible to easily ensure the operability of the wind instrument 1.

The thumbhole 14 may be constituted by a tone hole tube 30 extending from the outer circumference of the main tube 11 similarly to the pitch tone holes, as shown for example in FIG. 4.

The tube body 2 of the wind instrument may be arbitrarily constituted. That is, the tube body 2 may be constituted by only the main tube 11 without being provided with for example the auxiliary tube 12. In this case, the tube body 2 (main tube 11) is not limited to a cylindrical shape, and may for example be formed in for example a conical tube shape.

REFERENCE SYMBOLS

1, 2: Wind instrument
2: Tube body
3, 3A, 3B, 3C, 3D, 3E, 3F, 3G, 3H, 3I, 3J, 3K, 3L, 3M, 3N, 3O, 3P, 30: Tone hole tube
4: Mouthpiece
5: Bell
6: Finger pressing plate
8: Key mechanism
11: Main tube
12: Auxiliary tube
21: Inner open end
22: Outer open end
23: Curved tube portion
24: Inclined tube portion
31: Opening surface
A1: Tube axis of main tube
A2: Tube axis of tone hole tube

The invention claimed is:

1. A wind instrument comprising:
a tube body; and
a plurality of tone hole tubes each having an outer open end formed at the outer periphery of the tube body and an inner open end formed through the outer opening end and opening to the inside of the tube body,
wherein at least one of the tube body and the tone hole tubes is curved such that the plurality of outer open ends of the plurality of tone hole tubes are disposed so as to be in positions corresponding to respective fingers of the performer, and the plurality of inner open ends are connected at positions that cause the tube body to produce a predetermined pitch.

2. The wind instrument according to claim 1, wherein the plurality of tone hole tubes have portions extending in the upward direction of the tube body with respect to the tube body and that are mutually parallel, and
the tube body extends in the lengthwise direction of the tube body while curving a plurality of times in the vertical direction of the tube body.

3. The wind instrument according to claim 1, wherein the tone hole tube has an inclined tube portion in which the tube axis of the tone hole tube is inclined with respect to the radial direction of the tube body.

4. The wind instrument according to claim 1, wherein at least two outer open ends are in nearly the same position in the vertical direction of the tube body.

5. A wind instrument comprising:
a tube body; and
a plurality of tone hole tubes each having an outer open end formed at the outer periphery of the tube body and an inner open end formed through the outer opening end and opening to the inside of the tube body,
wherein the tone hole tube has an inclined tube portion in which the tube axis of the tone hole tube is inclined with respect to the radial direction of the tube body such that the plurality of outer open ends of the plurality of tone hole tubes are disposed so as to be in positions corresponding to respective fingers of the performer, and the plurality of inner open ends are connected at positions that cause the tube body to produce a predetermined pitch.

6. The wind instrument according to claim 2, wherein the tone hole tube has an inclined tube portion in which the tube axis of the tone hole tube is inclined with respect to the radial direction of the tube body.

7. The wind instrument according to claim 2, wherein at least two outer open ends are in nearly the same position in the vertical direction of the tube body.

* * * * *